US007062924B2

(12) United States Patent
Irvine et al.

(10) Patent No.: US 7,062,924 B2
(45) Date of Patent: Jun. 20, 2006

(54) METHOD AND APPARATUS FOR THE MANIPULATION AND MANAGEMENT OF A CRYOGEN FOR PRODUCTION OF FROZEN SMALL VOLUMES OF A SUBSTANCE

(76) Inventors: J. David Irvine, 404 Spruce St., Oakville, Ontario (CA) L6J-2H4; David D. Ladd, 1-Huron St. Huttonville, Brampton, Ontario (CA) L0J-1B0

( * ) Notice: Subject to any disclaimer, the term of this patent is extended or adjusted under 35 U.S.C. 154(b) by 0 days.

(21) Appl. No.: 10/719,654

(22) Filed: Nov. 21, 2003

(65) Prior Publication Data

US 2005/0109046 A1 May 26, 2005

(51) Int. Cl.
*F25D 13/06* (2006.01)
*F25D 17/02* (2006.01)
*F25C 1/00* (2006.01)

(52) U.S. Cl. ..... 62/63; 62/64; 62/74; 62/376

(58) Field of Classification Search ..... 62/62, 62/63, 64, 74, 373, 375, 376; 241/17, 21
See application file for complete search history.

(56) References Cited

U.S. PATENT DOCUMENTS 3,228,838 A * 1/1966 Rinfret et al. ..... 34/284
3,405,531 A * 10/1968 Davis, Jr. et al. ..... 62/63
3,768,272 A * 10/1973 Barrett ..... 62/64
3,857,974 A * 12/1974 Aref et al. ..... 62/64
4,479,363 A * 10/1984 Gibson et al. ..... 62/63
4,655,047 A * 4/1987 Temple et al. ..... 62/64
4,843,840 A * 7/1989 Gibson ..... 62/375
4,982,577 A * 1/1991 Milankov et al. ..... 62/381
5,522,227 A * 6/1996 Appolonia ..... 62/63
5,881,561 A * 3/1999 Viard ..... 62/63
6,216,470 B1 * 4/2001 Kosock et al. ..... 62/63
6,555,154 B1 * 4/2003 Jones et al. ..... 62/64

* cited by examiner

*Primary Examiner*—William C. Doerrler
(74) *Attorney, Agent, or Firm*—Thomas A. O'Rourke; Bodner & O'Rourke

(57) ABSTRACT

A method and apparatus for the manipulation and management process of cryogen such that it controls both the fluid body movement as well as internal currents within the cryogen. Small volumes of a desired substance introduced into this managed cryogen for the production of frozen or solidified pellets or granules are better managed as to shape, size, deformation, frozen satellites, fines and agglomeration and overall desired quality. These benefits result from the dispersion of the gas produced, as well as the heat transferred, resulting from the introduction of the relatively hot substance to the cryogen. The fluid body movement assists in maintaining a distance between the individual solidifying pellets or granules thereby minimizing deformation as a result of physical contact. The output characteristics and desired quality of the pellets can be more effectively controlled and managed, as desired.

44 Claims, 2 Drawing Sheets

FIG. 1
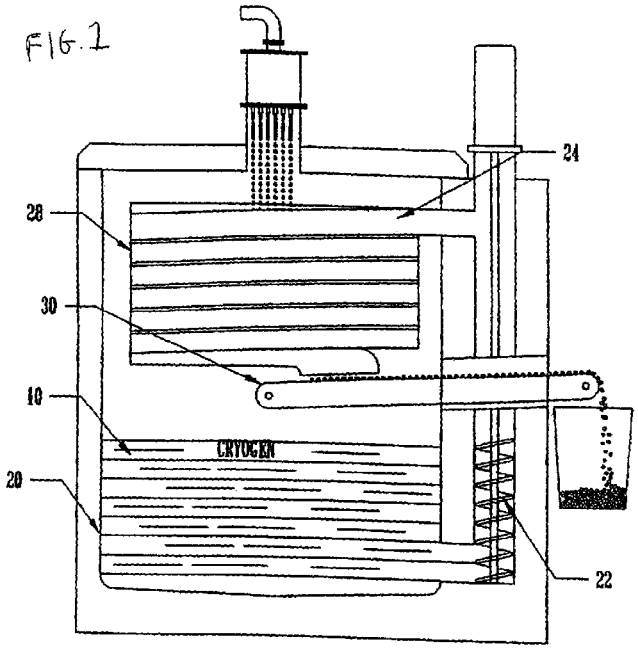
FIG. 4
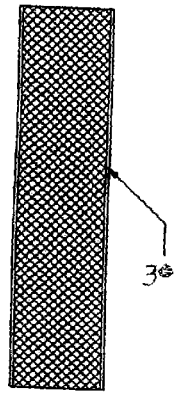
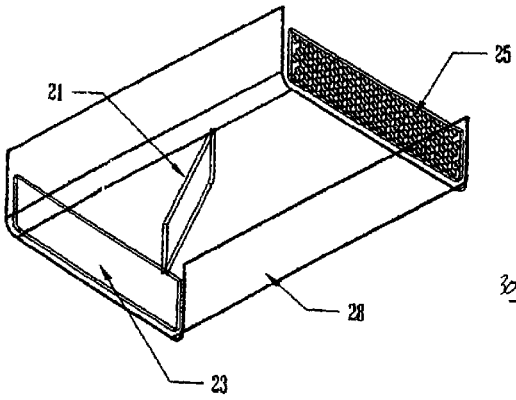
FIG. 3
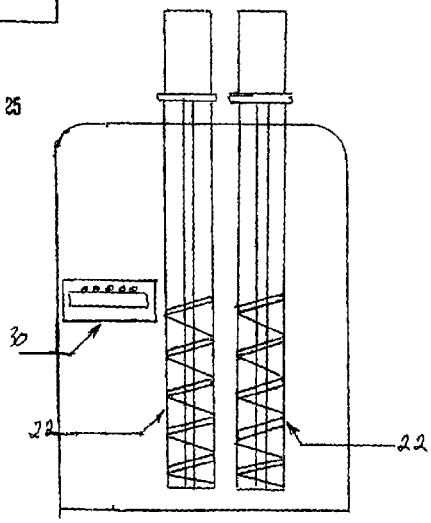
FIG. 5

METHOD AND APPARATUS FOR THE MANIPULATION AND MANAGEMENT OF A CRYOGEN FOR PRODUCTION OF FROZEN SMALL VOLUMES OF A SUBSTANCE

FIELD OF THE INVENTION

This invention relates to a method and apparatus for utilizing a cryogen including the manipulation, management and control of a cryogen. Cryogen can be utilized in the production of frozen and/or solidified small volumes of desired substances. The small volumes of solidified substances, also called pellets or granules in prior art, are hereinafter referred to as units.

The invention also relates to a method and apparatus for the manipulation, management, and control of the main body of the cryogen in combination with its internal currents.

BACKGROUND OF THE INVENTION

The desire for small volumes of substances, individually frozen or solidified has become greater as the technology has improved and the awareness and availability of such a product has increased. This demand includes food type products, bioactive products, chemical products, and in general any liquid, semi-liquid, semisolid or solid that may be desired to be frozen or solidified in small individual units. Small individual units do not demand the thawing of a large amount of product for utilization. Measurability, novelty, convenience, reduced waste, higher quality, ease of use, flowability, handling, minimizing cellular damage, and maximizing product efficacy are also advantages that industry is discovering with small frozen or solidified units. This demand has created a need for a product that has reasonable consistency of size, shape and other physical characteristics.

In the field of bio-active products, small frozen or solidified units have significant advantages. The freezing process is very fast and results in minimal cellular and structural damage, which provides maintenance of the desired bioactive characteristics.

The rapid freezing minimizes cellular damage caused by the formation of ice crystals, normally associated with freezing. Bioactive products are often freeze dried for storage. The characteristics of the units make them excellent for freeze drying. The more consistent the size and form of the units, the more favorable they are for a freeze drying process.

One of the advantages of a small volume of frozen or solidified product is that it can be made to flow like ball bearings (flowability). Thus, the handling of specific amounts of units that may vary with demand is possible. Agglomeration and deformed individual units inhibit the ability to flow as desired.

Measurement and utilization is also an important feature. If an average weight of the product is known, a specific amount can be utilized without thawing a larger block of product. The thawing of the desired amount of product is faster as a direct result of the relatively large surface area per unit of weight as compared to a frozen block of product. Many characteristics are improved significantly as a result of the rapid freezing or solidification of the small volume of liquids.

There is prior art in the field of production of frozen units by utilizing a cryogenic liquid. Much of the known art utilizes a particular cryogenic liquid, such as Liquid Nitrogen (LN2).

The main problem with the prior art is that the small volumes of substance are introduced into the cryogen with relatively little consideration of the manipulation and management of the cryogen itself. This results in the formation of random or poorly formed units. Creation of deformed units is commonly referred to as the "popcorn" effect. The units look like "popcorn" rather than smooth spheres.

Consistency of size, structure, texture and surface quality as well as control of agglomeration has not been able to be a manageable and controllable feature previously.

All of these variances result from the inability to control and manage the rapid heat transfer that occurs in the process. This rapid heat transfer results in remarkably violent gasification, which results from introduction of a relatively warm substance into the extremely cold cryogen. Gasification occurs at the interface between the cryogen and the forming units. Violent gasification results in cavitations at the surface of the cryogen resulting from the creation of gas bubbles, which can break the surface of the cryogen. Gas bubbles bursting at the surface of the cryogen can lead to incomplete and non-uniform immersion of the introduced substance into the cryogen. It also causes the units to violently interact. This violent interaction results in significant structural alterations of the units.

Agglomeration is also often a problem as the rapidly forming units often combine with other units resulting in multiple units combining and solidifying together. This agglomeration affects the flowability of the product as well as affecting other desired qualities The relevant prior art is referenced as follows:

Canadian Patent #937450:

This patent describes the deformation that would naturally occur when a small volume of liquid is entered into a body of cryogenic material.

Canadian Patent #964921:

This art describes a small volume of liquid being introduced into an unmanaged and static body of cryogenic liquid.

Canadian Patent #1217351 and U.S. Pat. No. 4,655,047:

This patent describes the improved formation frozen pellets. This patent describes the introduced liquid relative to speed into the body of cryogenic liquid.

Canadian Patent #2013094 and U.S. Pat. No. 4,982,577:

This patent identifies the previous patents' lack of ability to control the exposure of the cryogenic liquid to external heat sources and thereby the subsequent waste of the cryogenic liquid. Although it establishes a good method of handling the liquid for the purposes of cost, it does not identify, mention or claim the benefits of a process of manipulation of the fluid dynamics of the cryogenic liquid to produce the ability to manage the characteristics of the introduced liquid as it solidifies.

U.S. Pat. No. 4,687,672:

This patent describes a freezing of large volume of product and its subsequent fracturing and grinding to produce a granular product.

U.S. Pat. No. 5,126,156:

This art describes a liquid being introduced into a cryogenic liquid without any reference to manipulation or management of the cryogenic liquid only referring to the removal of the pellets from the liquid after freezing and a screening process to extract only the pellets from the liquid via an auger in a similar fashion to Canadian patent 964921.

U.S. Pat. No. 6,000,229:

The art is basically a tub of cryogen with an introduction point of cryogen. In addition an auger for the removal of solidified pellets. There is not any attempt to manage the heat transfer, gasification or other destructive aspects.

Generally, the prior art in the field focuses on the actual small volume of liquid being introduced and the handling and removal of subsequently frozen product from the liquid cryogen. The prior art typically does not identify or discuss what actually occurs within the body of the cryogen or any methods or apparatus for managing the heat transfer and gasification that directly affects the structure and formation of the pellet being produced.

OBJECTS OF THE INVENTION

The synergistic effects of the type of management of the present invention include but are not limited to:

a) The dispersion of gas produced by the heat transfer between the thermally different introduced substance and cryogen.

b) The dispersion of the heat transfer between the introduced substance and cryogen into the general body of the cryogen.

c) Maintaining a physical distance between individual units such that the destructive aspects of physical interactions are minimized.

This enables the improved management, control and determination of the desired characteristics of the individual units. The characteristics managed are the shape, size, surface texture, deformation, frozen satellites, fines, and agglomeration of the introduced units as they are frozen or solidified.

Accordingly, several objects and advantages of the present invention include the manipulation and subsequent management of the cryogen utilized in the solidification of a series and/or multiple units of small volumes of a substance introduced into the cryogen. In general practice the cryogen utilized may be Liquid Nitrogen (LN2) or other suitable low temperature liquid.

Accordingly a primary objective of the present invention is the creation of the synergistic effects resulting from a method and apparatus for the manipulation and management of both the general fluid body (Fluid Body Movement) as well as the internal fluid dynamics (Currents) of the cryogen. These synergistic effects are utilized to control the characteristics of the frozen unit resulting from the introduction of that unit into the body of cryogen, such as Liquid Nitrogen (LN2). The controlled characteristics may include the surface structure, agglomeration, fines, satellites, average size, roundness and the prevention of ice crystallization.

Another object of the present invention is the physical movement of an introduced unit out of the introduction area of subsequently introduced units as a result of the unit being carried by the flow of the LN2.

Another object of the present invention is the reduction of physical interaction of forming and formed units with each other thereby avoiding the obvious physical damage that the firmer formed unit would cause to the forming units.

Another object of the present invention is to facilitate the dispersion of the gasification resulting from the interface between the small introduced unit and the cryogen. This dispersed gasification also assists in the enhancement of currents within the body of the cryogen.

Another object of the heat and gasification dispersion resulting from operation of the present invention is faster heat transfer from the introduced units into the liquid cryogen, as a result of increased direct contact between the forming unit and the LN2.

Another object of gas dispersion resulting from operation of the present invention is the minimizing of physical damage done as a result of the violent gasification on the forming unit.

Another object of the invention is the ability to regulate properties of the units, including these characteristics of the solidified or frozen unit, as the market requires. Properties can range from "popcorn" type products with or without agglomeration to smooth sphere like units that are individual in nature and of primarily similar size and shape.

An additional object of the invention is the utilization of a recycling system to create the desired flow of the cryogen.

An additional object of the invention is the utilization of a sloped raceway of varying designs to maintain the flow of the cryogen.

Another object of the invention is the length of the raceway. The length of the raceway, from the point of introduction of units into the cryogen to the point of units/cryogen separation at the removal mechanism for said units, can be calculated utilizing cryogen flow speed and desired retention time of the units in the cryogen.

Another object of the invention is the encouragement or discouragement of the internal currents within the body of the cryogen as a result of the recycling process to assist in desired results.

Additional objects, advantages, and other novel features of the invention will be set forth in part in the description and scientific explanation that follows and in part will become apparent to those skilled in the art upon examination of the following or may discerned from the practice of the invention.

The prior art does not manipulate, manage or utilize any of the described factors that occur in the cryogen. Previous patents simply introduce a unit into a body of cryogen. The gasification of the LN2 is sufficiently violent that the introduced unit appears to float or levitate on top of the LN2 as a result of the lift power of the gasification. This occurs in spite of the fact that units, in general, are heavier than the LN2. The units at the surface or near the surface are a combination of individual units in all three stages of formation moving violently and randomly. With the violent gasification and the combination of all stages of formation in close proximity it can easily be understood by anyone skilled in the art why the deformation, damage, fragmentation and agglomeration and other characteristics result.

To achieve the foregoing and other objects and advantages, and in accordance with the purposes of the present invention as described herein, a method and apparatus for producing the desired synergistic effects by manipulation of both the body and internal fluid dynamics of the cryogen utilized in the production of a free flowing frozen or solidified product resulting from the introduction of small volumes of liquid called units into the body of liquid cryogen.

SUMMARY OF INVENTION

The cryogen, preferably Liquid Nitrogen (LN2), may be drawn from a reservoir or sump at the bottom of the apparatus, by a means to remove said cryogen from the reservoir, such as a recycling system. The recycling system may comprise one or more augers; however, other recycling methods could be utilized. One or more augers may be utilized depending upon desired results. Multiple augers can provide a greater recycling volume as well as increased internal currents. An apparatus which creates a suction effect, or another means to elevate the cryogen from the reservoir may be suitable.

The recycled LN2 may be moved substantially vertically or upwards from the sump by rotation of an auger. The upward motion of the cryogen may result in a bubbling spring effect when the cryogen begins to transition to horizontal flow. Also, there may be internal currents created within the body of the cryogen that are initially caused by the auger or other recycling system.

A cryogen auger (as example of pumping methodology) does not have to be completely vertical however the preferred arrangement for lift is an auger that is substantially vertical with a plurality of flutes to be machined at a preferred angle of about 14 degrees from center with a quantity of flute flights of between about 8 and 10 per auger. The flutes preferred spacing is about 2.5 inches apart. The most preferred condition is a substantially vertical auger with a flute angle of 14 degrees from center with a quantity of flute flights of 8 with a spacing between flutes of 2.5 inches. If it is decided to employ an auger angle other than substantially vertical all flute angles and quantity of flutes thereof can be adjusted accordingly to offset the other than substantially vertical condition to allow for similar lifting volume of the cryogen. Large numbers of flutes are possible but can result in added vibration.

The vertical movement of the cryogen can develop into a fundamentally horizontal movement as it flows away from this transition point. At the transition point, back currents created by a vertical flow may dissipate and before the introduction of the small volume of substances at the introduction point. Once the flow evolves to a fundamentally horizontal flow the currents created by the recycling system disperse any minor gasification that results, resulting in a reasonably smooth surface on the LN2. The initial slope of the raceway at the product/cryogen interface will assist in the management of the speed and depth of the body of LN2 at this juncture with the preferred slope being between about −5 degrees (upward slope) up to about +15 degrees downward slope from the horizontal and the most preferred slope being +5 degrees downward from the horizontal. The subsequent angle of travel along the raceway beyond the interface point is preferred to be about +5 to about +15 degrees downward slope with the most preferred at +7 degrees.

If the current is too strong for the desired results, a screen or baffles can be utilized in advance of the introduction point of the small volumes of liquid to slow down the internal currents.

The distance of the exit of the recycling system at the point of transition from vertical to horizontal flow to the introduction point of the small volume of desired substance may be of sufficient distance such that the vertically moving LN2 being recycled converts to horizontal flow, thereby allowing any back eddies created by the vertical flowing liquid changing to a horizontal flow to dissipate and settle and become a non-factor in the current of the cryogen. This distance may be a factor associated with the maximum flow that the recycling system is capable of creating.

Once the LN2 has achieved a smooth surface and a substantially mono-directional horizontal flow, a desired substance may be introduced into the cryogen via a nozzle either under pressure or by gravity feed. The substance that is introduced may be a stream, or as individual measured droplets in varying degrees of frequency or precision depending upon the desired production outcome required. The height of the nozzle above the introduction zone may be adjustable due to desired characteristics of units. Preferably, the nozzle may be at a height sufficient to limit disruptive current resulting from introduction of the substance. Also, preferably the introduction of the substance will not cause upward spray of the cryogen. The horizontal movement of the LN2 can move the forming unit out of the introduction zone where subsequent units may be continuously introduced into the cryogen.

The inherent and artificial currents in the LN2 may disperse the gasification created by the introduction of the small volumes of relatively warm substance into the cryogen. Dispersion of this violent gasification at a point away from the introduction zone may enhance the internal currents within cryogen.

The LN2 can be guided down a sloped raceway. The raceway is constructed in a variety of formats depending upon the desired effect, substance being frozen or solidified, and desired retention time. The raceway may have a stainless steel surface, such as a "mirror" finish applicable in stainless steel polishing in the pharmaceutical industry, or other applications where a smooth finish is utilized. Finishes are typically determined pursuant to the regulatory bodies governing such things for individual industries, such as the FDA. These surface finishes can facilitate cleaning and disinfection of the system when required. In industry, often when there is a change from one product type to another it is essential that substantially the entire previous product be removed and cleaned. This is particularly imperative with bio-active products. In addition the smoother the surface the less the frictional resistance of the surface becomes a parameter in the movement of the cryogen or the individual units.

The cross section shape of the raceway may be an expanded "U" shape in order to facilitate cleaning and disinfection after use of the equipment. However, the raceway may be enclosed, such as a tube. A "U" shape can minimize corners that would affect the desired currents and flow for the cryogen. The "U" shape may also minimize damming or conglomerations of the units as they proceed down the raceway.

One embodiment of a raceway may be a spiral raceway. The slope of the raceway can be a function of the desired speed of the body of LN2 that is desired. The length of the spiral can be a function of the desired retention time of the forming and formed units. The longer the raceway or spiral the greater the retention time of the units. The slope of the spiral may also be a function of the desired retention time of the units and the desired speed of the cryogen. A greater the slope of the spiral will increase the rate of flow of the cryogen through the spiral.

The spiral formation can present additional benefits in that the currents and flow may not develop the opportunity to stabilize as easily as they would in a linear raceway.

Another embodiment of a raceway may be a series of linear raceways. The linear raceways may have a similar expanded "U" shape, or may be enclosed in a tube form.

The raceway can be made up of a series of cascading linear raceways, whereby a first linear raceway feeds into a receiving linear raceway running in a substantially different direction. This cascading of the cryogen from a first raceway into the receiving raceway may cause a general mixing of the cryogen and the units. This cascading effect may enhance the internal currents within the cryogen.

Again, the overall length of the embodiment of the linear raceway can be a function of desired retention time of the introduced units. A particular velocity of the cryogen and a specific length of raceway may result in different durations that the units are in the body of cryogen in advance of being removed by the extraction system.

The actual number of cascades utilized can be a function of the desired size of the equipment and the enhancement of the currents desired. However, the more cascades that are utilized the more that the internal currents may be enhanced.

A further embodiment of the present invention may be a linear raceway without any cascading or spiral action. Again, the slope and length of this design may be a function of desired speed and retention time of the units.

Upon exiting the raceway, the cryogen may travel through a moving screen or wire mesh belt. Preferably, the screen or wire mesh is of a conveyor belt style. The porous screen or mesh can be designed to allow the passage of the cryogen through it while removing the resultant solidified unit. The separation of the unit from the cryogen can be referred to as the removal point.

The escape of the gasification that has occurred in the cryogen may be via the same exit point as the units on the conveyor belt. Similarly, another advantage may be the utilization of heat transfer from the units to the gas as it escapes with the extraction of the units from the equipment.

Once passing through the screen or belt, the cryogen may be returned to the sump. There, the returned cryogen can be re-fed into the recycling system, and the process be made continuous.

EXAMPLES

In order to effectively describe the advantages of the invention, the physics and science of the introduction of a small volume of substance, preferably a liquid, semi-liquid, semisolid or solid, into a body of cryogen, such as LN2, is presented as follows.

Example 1

For this example water ($H_20$) will be utilized as the sample introduced liquid and Liquid Nitrogen (LN2) will be utilized as the cryogenic liquid.

Definitions and standards utilized:

Temperatures will be presented in Kelvin (K), with a conversion to Celsius (C) and Fahrenheit (F).

1. "Freezing Point" of water ($H_20$)=273.15 K
2. 273.15 K=32 degrees F=0 degrees C.
3. 1 degree Celsius=1 degree Kelvin
4. 1 gram (gm) of $H_20$=1 cubic centimeter (cc) of $H_20$
5. 1 cc.=1 cubic centimeter=1 gram of $H_20$
6. calories=1 calorie=the heat required to raise 1 gram of $H_20$ 1 degree K
7. "Heat of Fusion" of $H_20$=79.7 cal/gm=79.7 cal/cc
8. "Vaporization Point" of Liquid Nitrogen (LN2)=77.4 K
9. "Heat of Vaporization" of LN2=2.7929 kJ/mol of LN2
10. 1 Mol of LN2=28.0134 gm.
11. 1 cal=4.184 joules
12. LN2=0.807 gm/cc=1.239 cc/gm.
13. 2.79 kJ/mol=23.83 cal/gm=29.526 cal/cc.
14. 1 cal converts 0.642 grn of LN2 to gas or 0.034 cc of LN2 to 5.91 cc of Nitrogen gas.
15. Expansion factor of LN2 liquid to a gas at vaporization temperature=174.6 volume of expansion.

When 1 gram (1 cc) of $H_20$ is introduced into a body of cryogen, being LN2, the heat transfer falls into three main categories:

1. The energy exchange in the lowering of the temperature of the introduced liquid to the point where a 'Phase Change' of the introduced $H_20$ occurs.
2. The energy exchange associated with the change of phase "Heat of Fusion" 273.15 K or 0 C or 32 F.
3. The energy exchange as the temperature of the units decreases to the desired exiting temperature, below 273.15 K, 0 C or 32 F.

Above the fusion temperature of water, or pre-solidification:

It requires 1 cal of energy release from the $H_20$ for each degree K of change above the "Fusion" temperature of the introduced water. Therefore it utilizes 0.0411 gm or 0.0339 cc of LN2 for each degree change with a subsequent gas release of 5.9134 cc of Nitrogen gas per degree of change of the $H_20$.

The physical properties of the introduced small volume of liquid may be very vulnerable during this stage as the unit retains its fluid properties, and hence, most susceptible to deformation, separation and fragmentation as well as agglomeration with previously introduced units and each other. As the crust is formed and solidification is initiated, any physical interaction may cause significant deformation of the forming unit, and possible agglomeration with other forming or formed units.

The phase change of the introduced liquid:

It requires 79.7 cal of heat exchange for the "Heat of Fusion" of the introduced product.

Therefore this heat exchange vaporizes 79.7×0.0411 gm or 79.7×0.0339 cc of LN2.

This result is the release of 471.28 cc of nitrogen gas.

In a practical application the "Heat of Fusion," as well as the temperature at which the phase change occurs will vary depending upon the number of solids in the unit and the percentages of other liquids in the units such as lipids (fats), salts, spices, etc.

The physical properties of the forming unit at this stage can be vulnerable to a more limited extent. In a practical application the solidification may not occur as rapidly as in the H20 example. The presence of oils, solids, etc. in the liquid will result in the product being plastic or soft for a greater range of temperature. This results in a product that can be sensitive to physical damage such as deformation, as well as agglomeration with other units until complete solidification occurs.

Below the fusion temperature, or post-solidification:

It requires 1 cal of energy release from the $H_20$ for each degree of change below the "Fusion" temperature of the introduced water. Therefore, it utilizes 0.0411 gm or 0.0339 cc of LN2 for each degree change with a subsequent gas release of 5.9134 cc of Nitrogen gas per degree of desired change.

The ability of the unit, when solidified, to transfer heat may increase once it is solidified.

The physical properties of the frozen or solidified fluid below the fusion temperature are essentially constant, and additional damage or deformation is minimal, if even evident. A benefit to dispersion of gas produced and maintenance of distance between forming units is during the forming, pre-solidification, stage of the units.

In a model where the water is introduced at 278.15 K or 5 C or 41 F and the removal temperature is 165 K that is −108 C or −162 F, the gas production per cc of introduced $H_20$ input is:

Stage 1=5 cal×5.91 cc/cal=29.6 cc of gas released
Stage 2=79.7 cal×5.91 cc/cal=471.28 cc of gas released
Stage 3=108 cal×5.91 cc/cal=638.62 cc of gas released This is a total of 1139.5 cc of gas produced within the body structure of the LN2 per gram or cc of $H_20$ introduced. As evident by this example, rapid Nitrogen buildup, or violent gasification, can result from the introduction of the relatively hot units into the LN2. This violent gasification may have a significant affect upon the internal currents and movement of the units within the body of the LN2.

Escaped gas can be utilized for additional cooling when the units are removed from the equipment on the conveyor screen.

Once the basic structure of the unit has taken place, the gas release of the individual unit slows down and the unit then sinks into the body of the LN2. Without management, virtually all the damage that would have been done to the physical characteristics would have occurred.

In a production system there is also a steady state loss of LN2 due to the operation of the equipment. The LN2 will vaporize even without the introduction of external units. This gasification is approximately 5,500 cc or 5.5 liters or 0.2 cubic feet per minute.

A system producing 200 lbs/hr and operating at an LN2 flow rate of 50% of motor capacity for a single auger LN2 pump and producing a product of approximately 15% to 25% solids will result in the following: The equipment-caused gasification would be approximately 5,500 cc of gas per minute, while the gas production from introduced units would be 1,730,000 cc of gas per min.

Example 2

A production system processing approximately 90 kilograms or 200 lbs of output per hour will release in excess of 1,730 liters or 61 cubic feet of gas per minute. Over 95% of that gas would be released normally at the interface of the introduced units and the LN2. This substantial gas release at the introduction point can lead to many adverse formation conditions, such as those previously mentioned.

In a production example, actual units range in size depending upon the introduction nozzles utilized and the particular characteristics of the liquid, semi-liquid, semi-solid or solid. The average size may be from about 0.1 cc to 0.5 cc in size, but not limited to these sizes. The size of the unit will not affect the amount of gasification; however, the speed of the heat transfer will increase as the total surface area per total weight of product increases.

It can also be easily seen by anyone skilled in the art that violent gasification does occur and occurs very quickly at the interface between a forming unit and the LN2. In addition this violent gasification would affect the movement and interaction of units in the body of the cryogen. This type of reaction explains the deformation, size variances, surface characteristics and agglomeration that are noted to occur in the prior art.

BREIF DESCRIPTION OF THE DRAWINGS

FIG. 1 is a cutaway view of a representative apparatus of the present invention.

FIG. 3 is a perspective view of showing different control means for the present invention.

FIG. 4 is a top view of the screen conveyor belt of the present invention.

FIG. 5 is a side view of the auger of the present invention.

DETAILED DESCRIPTION OF THE INVENTION

Figure 2:
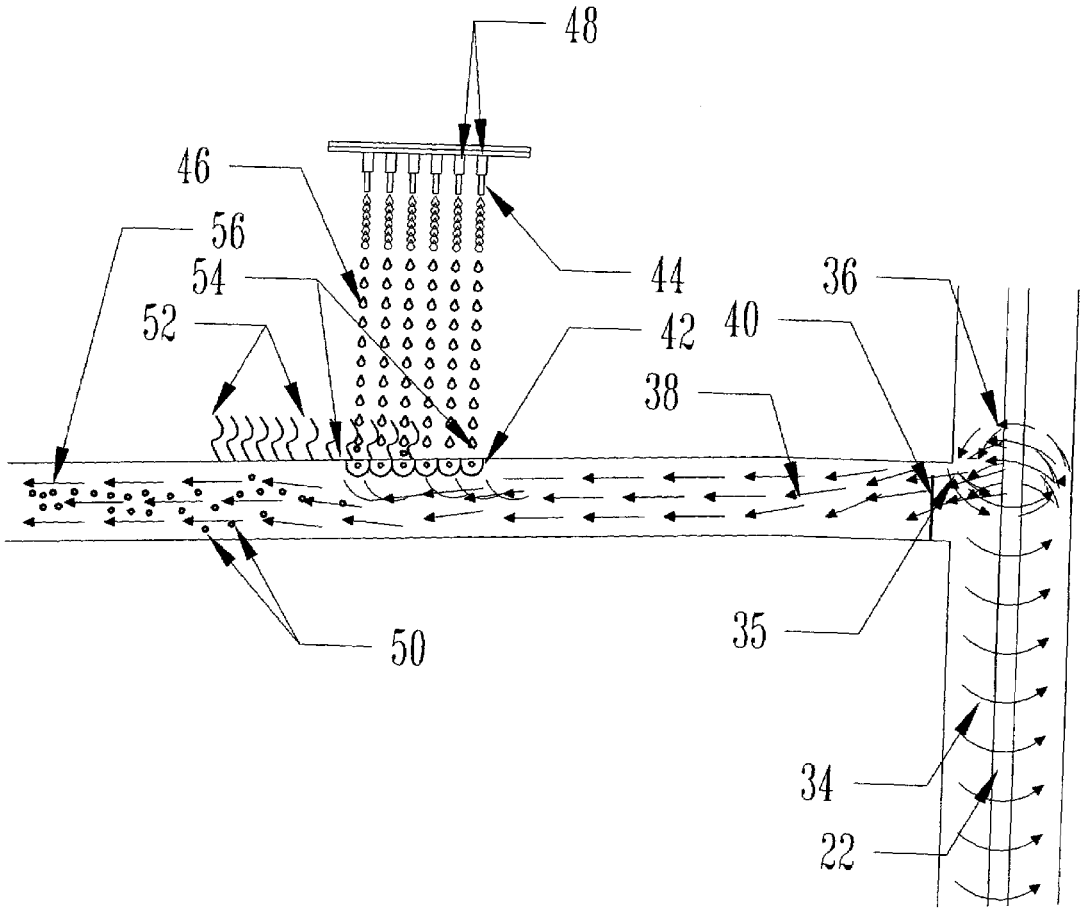
FIG. 2 is a cutaway view of the introduction point of the apparatus of the present invention.

Having summarized various aspects of the present invention, reference will now be made in detail to the description of the invention as illustrated in the drawings and described in the scientific description. While the invention will be described in connection to these drawings and description, there is no attempt to limit the invention to the embodiment or embodiments disclosed herein. On the contrary, the intent is to cover all alternatives, modifications and equivalents included within the spirit and scope of the invention as defined by the appended claims.

Reference is now made to FIG. 1 showing the apparatus of the present invention. Cryogenic liquid may be stored in a sump (20), or reservoir, at the bottom gravitational location of the apparatus. The cryogen may be lifted to the entrance of the raceway (24) via one or more augers (22), as seen in FIG. 5. Alternatively, an impellor-type pump may be used to created vertical flow of cryogen up to the raceway (24). The cryogen may then transition from vertical movement to horizontal flow, and initiate its travel down a sloped raceway (28).

The slope of the raceway can be a factor in the management of cryogen movement in the preferred embodiments for the slope being as follows for the top of the raceway at the product/cryogen interface. The length of the raceway, from the point of introduction of units into the cryogen to the point of units/cryogen separation at the removal mechanism for said units, can be calculated utilizing cryogen flow speed and desired retention time of the units in the cryogen.

The preferred slope can range from about −5 degrees (upward slope) to about +15 degrees (downward slope) from horizontal. Most preferably the slope is +5 degrees (downward slope from horizontal). The raceway slope can be produced to be adjustable across a desired range. Beyond the product/cryogen interface the raceway slope is preferred at about +5 to about +15 degrees downward slope with the most preferred at +7 degrees.

The cryogen with units contained therein can pass though a moving screen conveyor belt (30) that removes the solidified units from the cryogen. The conveyor belt (30) may be made of a screen, a wire mesh, or any suitable porous material that will filter the solidified or frozen units from the cryogen. The cryogen may then return to the sump (20) where it is recycled again.

The pumping capacity of the auger can be in excess of the ability of the cryogen in the sump to keep the entrance full of cryogen. If this operational condition was created, cavitations in the cryogen may occur if the auger is run too fast thereby introducing gas into the auger process. Cavitations in the cryogen may result in the vertical flow not being consistent. Also, an embodiment of the recycling system that consists of two or more augers thereby enables an increased flow without causing the undesirable cavitations and subsequent flow inconsistency.

The cryogen auger (as example of pumping methodology) does not have to be completely vertical however the preferred arrangement for lift is as follows: The auger can be substantially vertical with a plurality of flutes to be machined at about a 14 degree angle from center with a quantity of flute flights of between about 8 and 10 per auger. The flutes preferred spacing is about 2.5 inches apart. The most preferred condition is a substantially vertical auger with a flute angle of 14 degrees from center with a quantity of flute flights of 8 per auger, with a spacing between flutes of 2.5 inches. If it is decided to employ an auger angle other than substantially vertical all flute angles and quantity of flutes thereof can be adjusted accordingly to offset the other than substantially vertical condition to allow for similar lifting volume of the cryogen. Large numbers of flutes are possible but can result in added vibration.

Reference is now made to FIG. 2 in which the flow transition point is depicted. The cryogen may be lifted by the auger to enter the raceway (24). Motion of the auger (22) may create a circular and vertical direction (34) of the cryogen. Upon exiting the recycling system at the top of the auger, the direction of the fluid body movement is vertical and circular. The flow may change to a fundamentally horizontal flow. The transition from vertical to horizontal flow may result in the production of back eddies and reverse currents (36). Back eddies and reverse currents (36) can result in a spring bubbling-effect up into a body of cryogen then flowing in a horizontal direction.

These back eddies and reverse currents can be allowed to settle out as the fluid converts to basically horizontal flow (38) in advance of the introduction point (42) of the small volumes of a desired substance, such as liquid, semi-liquid, semisolid or solid. Upon introduction into the cryogen, these small volumes may be referred to as units. In another embodiment, a control means (40) may be introduced at the flow transition point to decrease the intensity of the back eddies and reverse currents. The control means may be a barrier, screen (25), baffle (21), or dam (23), as seen in FIG 3. In a further embodiment, the apparatus may be adapted to inject a time delay for flow transition. In this embodiment, the auger may rotate with slower speed, there may be a dam before the introduction zone, or a diffusion pool may be added after the introduction zone.

The length of the raceway can determine the retention time of the units as a function of desired exiting temperature or required time necessary to ensure solidification in the cryogen given a particular speed of motion. In some cases the depth or speed of the cryogen can be adjusted to adjust retention time. In such cases a baffle, screen or a dam is placed in the raceway after the introduction point. A dam obviously increases the depth of the cryogen. A baffle aids in the direction of flow of the cryogen and units. A screen aids in the control of the internal currents in the cryogen.

The recycling of the cryogen can maintain a constant circular flow as it travels down the raceway back to the sump and up again to the entrance to the raceway (24).

The small volumes of substance can be introduced to the cryogen flow via a series of introduction nozzles (44) that introduce the liquid by streaming, or as individual droplets, either by gravity feed or under pressure. Droplets (46) can be predefined in volume by a specialized pump or can be determined by the particular surface tension of the liquid and form a droplet that can be released like a drip from a dripping tap.

The number of nozzles utilized for the introduction of small volumes of liquid, are a function of the engineering of the total unit. Preferably, multiple nozzles may be utilized. The actual number of nozzles utilized is a function of the total volume of liquid that the system can sustain while still maintaining the desired results. In general, the faster the speed of individual units being introduced, the faster the lateral movement of the cryogen required in order to achieve the results desired. In addition to pure cryogen velocity the higher the number of individual units being introduced the greater the surface area of the introduction point required.

The introduction point (42) may be positioned downstream from the introduction of the recycled cryogen such that eddies and back currents may have time to settle and a consistent forward flow is achieved. However, the introduction point (42) may be the same position as the entrance point (35). The distance from the recycled cryogen entrance (35) to the introduction point (42) can be dependent upon the maximum flow capacity desired for the equipment. An example of a desired result at the introduction point is a reasonably smooth surface on the flowing cryogen.

Preferably, the distance between the nozzles (48) is sufficiently distant such that the droplets or steams will not combine with each other before hitting the surface of the cryogen. Combination of droplets may also be a function of the height of the nozzles above the cryogen surface. Also, the nature of the product being processed can influence the combination of the droplets. The distance between nozzles, height above cryogen surface and nature of product being processed are variable and may be adjusted by user-designation.

When a droplet is introduced into a horizontally moving body of cryogen, the resulting unit may be moved away from the introduction point (42). The faster droplets are introduced, the faster the flow of cryogen that is required to move the unit (50) out of the way of the next introduced unit. Preferably, the unit is transported immediately from the introduction zone by the horizontal cryogen flow, thereby reducing the interaction between droplets and unformed units. The speed of the process may be controlled partly by the volume of cryogen recycled, the speed of the recycling of the cryogen, and the slope of the raceway.

Another management tool is the distance that the droplet will pass through before coming into contact with the LN2. The distance of the droplet height or individual liquid unit height from the body of LN2 can be dependent upon the liquid product to be frozen and could range from very low to very high. The preferred variance is from about 4 inches to about 36 inches above the cryogen. Depending on the product makeup (i.e. solid contents, viscosity and surface tension) and the desired results one wishes to achieve (i.e. consistent shaped pellets of varying degrees or misshapen and agglomerated pellets (i.e. Popcorn shaped) or many other combinations including frozen splatter) the height variance can be substantial. Also, liquid product pumping capacity may require establishment as to not overburden the system with too much liquid to be frozen and hence compromise the results desired or efficiencies of a certain type and size of unit/equipment. Testing of these parameters can be established to correlate to the needs of a particular end user and hence management for said requirements can be forecasted and built in to satisfying the existing and future needs of a user.

The distance of drop or droplet combined with its size and mass will to an extent demand that a particular depth and speed of LN2 be available in order to inhibit the droplet from hitting the actual bottom of the raceway in advance of the droplet forming its initial crust.

This methodology results in the gasification created by a particular unit not being added to the gasification of the next unit. In addition, increased flow may prevent the physical interaction of units while they are very susceptible to physical damage, as they are remote from each other.

The violent gasification results in cavitations. Cavitations (54) are individual bubbles that eventually break the surface of the cryogen. In effect the surface becomes covered with cavitations, which present a jagged surface to which the droplets contact. However, these cavitations can be remarkably destructive to droplets when they are introduced into the flow of cryogen. Maintenance of a smooth cryogen surface at the introduction area can be one of the essential parameters in managing the form and structure of the resultant units. This may be accomplished by maintaining a steady horizontal flow of cryogen (56).

As the heat is transferred from the units to the body of cryogen, the currents may move the actual cryogen molecules that are in the process of going through a change of phase or vaporization. Since the actual molecules that are absorbing heat are continually being moved away from the solidifying unit much of the gasification that would normally occur at the interface may be delayed or occur at a point away from the interface.

The internal currents, still active due to the recycling systems' motion, assist in the dispersion of the gas and heat from the interface. The gasification that occurs within the body of the cryogen can create additional currents that assist in the dispersion of subsequent gasification and heat. The movement of the gas bubbles through the fluid body of the cryogen enhances the existing currents and creates new ones. These currents can aid in the desired effect created by the currents. This can minimize physical damage as a result of the violent gasification. The movement of the gasification and heat away from the interface minimizes the normal encapsulation of the forming unit by the gasification. When a unit is encapsulated in gasification the speed of heat transfer is inhibited, as the gas does not absorb heat as quickly as the liquid cryogen absorbs heat. The result of minimizing encapsulation is that physical contact with the liquid cryogen is maximized, thereby maximizing heat transfer.

The newly forming units are physically moved out of the way of the next introduction of units as a result of this controlled lateral flow of cryogen, thereby minimizing the physical interaction of forming and formed units with each other. The continued flow down the sloped raceway can maintain this distance between the units. This may assist in controlling the agglomeration that would be expected to occur, as well as the physical interaction and resulting deformation or structural damage to the units that would result.

Depending upon the product and the management desired in general it is preferred that the cryogen flow be such that product is moved away from subsequent newly introduced product. However for some products minimal or substantial no flow of the cryogen may be advantageous. This is because even without any river type flow of the cryogen there is substantial currents and resulting movement thereof caused within the body of the cryogen as a result of the significant gasification that occurs at the interface between the introduced product and the cryogen. This substantial movement is over and above the great deal of movement that already occurs from the steady state gasification that occurs even without the introduction of the substance to be frozen.

The preferred rate of cryogen flow is relative to the individual liquid units to be frozen however for each product there can be established of a most preferred rate. This is ultimately accomplished through the testing of each individual liquid type product to be frozen and adjusting the parameter for cryogen flow accordingly to establish a most preferred rate. As well the amount of pumping capacity can vary with the size of each piece of equipment constructed and the number of pumping sources available. For some of what may be considered larger sized pieces of equipment produced (this is of course somewhat subjective to individual industry definition of larger scale) a preferred range for cryogen pumping capacity for example would be about 100 to about 150 liters of cryogen per minute into a river width of about 8 to 12 inches. A most preferred rate would be 120 liters per minute of pumping capacity with a river width of 10 inches. It is important to note that this technology is scaleable (small and large). For comparative purposes for smaller sized equipment than that as cited above the above ranges could be about 50% of those values (once again dependent upon industry definition and need). The cryogen depth can be managed to be within a preferred rate of from about 1 inch to about 3 inches deep by adjusting the cryogen flow rate and/or the horizontal slope of the tray and/or by introducing a downstream flood gate/dam or a narrowing of the raceway that will allow more or less cryogen to flow over it past its point of location depending upon the cryogen depth desired.

For example, a product of composition such as skim milk dropping simultaneously from approximately 48 nozzles from a height of between 20 and 25 inches into a flowing cryogen source moving along a 10" trough at a +5 degree angle at the point of interface and then descending at a rate of approximately 2.5 feet per second for a time of approximately 20 seconds (residence time) will produce a consistent size and shape of pellet in a quantity of approximately 325 to 375 pounds per hour.

In specialized product situations, individual channels can be built in the raceway such that each nozzle utilized at the introduction point directs the droplets to follow a particular channel thereby stopping any horizontal interaction between units that were introduced at the same time.

When the gasification is removed remotely from the interface and mixed into the general body of the cryogen, the gasification can create additional random mini-currents within the body of the cryogen that assist in the general manipulation of the inherent currents and their subsequent effect as well as encouraging continued movement of the gasification.

This movement of the gasification away from the interface inhibits the initial floatation or levitation of droplets caused by the violent gasification (52), thereby minimizing the interaction of floating units that are randomly thrown around and have the possibility of hitting the sides of the raceway and/or each other.

The form of the raceway can also assist in this management and manipulation. A spiral raceway can continually change the direction of the flow of the cryogen thereby not allowing it to stabilize in a particular direction. A cascading raceway may cause the cryogen to cascade thereby enhancing internal currents and thereby fortifying random currents and flow. A linear raceway may allow the flow to stabilize.

The solidified units may be removed from the flow of cryogen via a conveyor belt screen with spacing in the screen such that the cryogen flows through the belt while the formed units do not flow through the belt. The belt may take the formed units to the exterior of the equipment where they are stored or utilized as desired. The exit of the cryogen gas due to evaporation or gasification from the equipment can be where the conveyor belt removes the solidified units. Therefore, the units after removal from the cryogen may be in an atmosphere of very cold gas. By adjusting the speed of the belt, the time that the units are exposed to this cold gas can be determined. There may be additional cooling of the units from this exposure to the expelled gas.

The invention claimed is:

1. A method of manipulation and management of the motion and currents of a liquid cryogen utilized in the freezing or solidifying of individually small volumes of a liquid or units, characterized by transporting liquid cryogen from a reservoir in a first direction upwardly from the reservoir to a single raceway, said cryogen having a transition point where the direction of flow of the cryogen changes to a second direction;

managing the speed of travel and volume of the cryogen at it travels in said raceway from the transition point to reduce gasification of the cryogen and any back eddies created in the flow of said cryogen caused by said change of direction;

introducing a liquid to be frozen by said cryogen while said cryogen is traveling in said second direction, said liquid being introduced via one or more orifices into said raceway at a distance remote from the cryogen, such that the small volumes of said liquid form into frozen units, adjusting the flow of the cryogen by a control means located in said raceway after the introduction of said liquid to said cryogen.

2. The method according to claim 1 wherein said units of said liquid are frozen in a desired shape.

3. The method according to claim 2 wherein the shape of said frozen units of liquid is a "Popcorn" structure.

4. The method according to claim 1 wherein there is a means for reducing the internal currents of the cryogen traveling in said second direction positioned prior to the introduction of the liquid to be frozen.

5. The method according to claim 4 wherein the means for reducing the internal currents is a screen.

6. The method according to claim 4 wherein the means for reducing the internal currents is one or more baffles.

7. The method according to claim 4 wherein the means for reducing the internal currents is one or more dams.

8. The method according to claim 1 wherein said first direction is a generally vertical direction.

9. The method according to claim 1 wherein said second direction is generally a horizontal direction.

10. The method according to claim 1 wherein the cryogen travels down a slope while traveling in generally said second direction.

11. The method according to claim 1 wherein said cryogen travels along at least one raceway when traveling in said second direction.

12. The method according to claim 11 wherein said raceway is sloped.

13. The method according to claim 12 wherein the raceway is a spiral raceway.

14. The method according to claim 11 wherein said first raceway feeds said cryogen into a second raceway running in a substantially different direction from said first and second directions.

15. A method of claim 1, wherein the cryogen has sufficient forward motion, such that units formed in said cryogen are moved away from where said liquid is introduced to said cryogen so as not to contact subsequently formed units formed from said liquid.

16. A method of claim 1, wherein the forward motion of the cryogen is utilized to move the gasification of said cryogen remotely from the introduction point of said liquid into said cryogen.

17. A method of claim 1, wherein the forward movement of the cryogen is utilized to move the cavitations caused by gasification of the cryogen away from the introduction point of said liquid into said cryogen.

18. A method in claim 1, wherein the cryogenic liquid moves in a mono-directional manner as it passes the introduction point of said liquid.

19. A method of claim 18, wherein the introduction point is of sufficient distance from the transition point that the cryogen is moving in substantially a horizontal direction.

20. A method in claim 1, where the internal currents, within said cryogen are multidirectional in nature prior to the introduction of said liquid.

21. A method of claim 20, whereby the currents at the point of introducing said liquid minimize gaseous encapsulation of the solidifying units.

22. A method of claim 1, wherein said small volume of liquid is sufficiently liquid that it can be dripped or pumped through a small orifice into said cryogen.

23. A method of claim 22, where said small volume of liquid contains a percentage of solids.

24. A method of claim 11, where the raceway has one or more channels to reduce horizontal contact between frozen units that are traveling down the raceway.

25. A method in claim 11, where the slope of the raceway controls the forward movement of the cryogen.

26. A method of claim 11, where the length of the raceway controls the retention time of the unit in the cryogen.

27. A method of claim 4, where the means for reducing the internal currents of the cryogen traveling in said second direction prior to the introduction of the liquid to be frozen controls the depth of the cryogen.

28. A method of claim 4, where the means for reducing the internal currents of the cryogen traveling in said second direction prior to the introduction of the liquid to be frozen controls the forward motion of the cryogen.

29. A method according to claim 1, wherein the manipulation and management of the motion and currents of a liquid cryogen removes the gasification of the cryogen away from the introduction point of the liquid into the cryogen.

30. A method according to claim 29, wherein the gasification of the cryogen away from the introduction point of the liquid into the cryogen enhances the internal currents in the cryogen.

31. A method according to claim 1, where the manipulation and management of the motion and currents of a cryogen assist in dispersing the heat transferred from the units formed from the liquid to the cryogen.

32. A method according to claim 31, wherein the heat transferred between the unit and the cryogen is enhanced by limiting the gaseous encapsulation around the unit.

33. A method according to claim 32, where the dispersion of the heat transferred reduces the gasification of cryogen at the interface between the cryogen and the frozen body.

34. A method according to claim 33, where gasification occurs in the cryogen instead of in the liquid introduced into the cryogen.

35. A method according to claim 1, wherein the structure, shape, agglomeration and sizing of the individual units formed from the liquid introduced into the cryogen can be predetermined and controlled by the manipulation and management of the cryogen.

36. A method according to claim 1, wherein the cryogenic liquid is recycled via a recycling system.

37. A method according to claim 1, wherein the liquid cryogen is transported from said reservoir to said transition point by means of one or more augers.

38. A method according to claim 11, where the cryogenic liquid is transported by two or more augers from the reservoir to the beginning of the raceway.

39. A method in claim 38, where the utilization of two or more augers increases the internal currents in the cryogen.

40. A method of manipulation and management of the motion and currents of a liquid cryogen utilized in the freezing or solidifying of individually small volumes of a liquid or units, characterized by transporting the liquid cryogen in a continuous flow from a reservoir in a first direction by means of two or more augers to single raceway, said cryogen having a transition point, changing the direction of travel of the cryogen at said transition point to a second direction of travel in said raceway;

managing the speed of travel and volume of cryogen from the transition point by the use of a means for reducing the internal currents of the cryogen to reduce gasification of the cryogen and any back eddies created in the flow of said cryogen caused by said change of direction;

introducing a liquid to be frozen by said cryogen while said cryogen is traveling in said second direction and after said cryogen has passed said means for reducing, said liquid being introduced via an orifice at a distance remote from the cryogen, such that the small volumes of said liquid form into frozen units, adjusting the flow of the cryogen by a control means located in said raceway after the introduction of said liquid to said cryogen.

41. The method according to claim 1 wherein said control means located in said raceway after the introduction of said liquid to said cryogen, is a dam that increases the depth of the cryogen.

42. The method according to claim 1 wherein said control means in said raceway after the introduction of said liquid to said cryogen, is a baffle to aid in the direction of flow of the cryogen.

43. The method according to claim 1 wherein said control means in said raceway after the introduction of said liquid to said cryogen, is a screen that aids in the control of the internal currents of the cryogen.

44. A method of manipulation and management of the motion and currents of a liquid cryogen utilized in the freezing or solidifying of individually small volumes of a liquid or units, characterized by transporting liquid cryogen from a reservoir in a first direction upwardly from the reservoir to a single raceway, said cryogen having a transition point where the direction of flow of the cryogen changes to a second direction;

managing the speed of travel and volume of the cryogen at it travels in said raceway from the transition point to reduce gasification of the cryogen and any back eddies created in the flow of said cryogen caused by said change of direction;

introducing a liquid to be frozen by said cryogen while said cryogen is traveling in said second direction, said liquid being introduced via one or more orifices into said raceway at a distance remote from the cryogen, such that the small volumes of said liquid form into frozen units, removing frozen units from said cryogen by a conveyor belt screen having spacing such that cryogen flows through the screen of said belt and the frozen units do not.

* * * * *